US008909126B2

(12) United States Patent
Takekawa et al.

(10) Patent No.: US 8,909,126 B2
(45) Date of Patent: Dec. 9, 2014

(54) SHEET PROCESSING APPARATUS, AND IMAGE FORMING SYSTEM

(75) Inventors: Kenichi Takekawa, Aichi (JP); Yasuki Matsuura, Aichi (JP); Masanobu Kimata, Aichi (JP); Isao Yasuda, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 886 days.

(21) Appl. No.: 12/273,928

(22) Filed: Nov. 19, 2008

(65) Prior Publication Data

US 2009/0129840 A1 May 21, 2009

(30) Foreign Application Priority Data

Nov. 19, 2007 (JP) ..... 2007-298791

(51) Int. Cl.

*G03G 15/00* (2006.01)
*B65H 45/14* (2006.01)
*B65H 29/60* (2006.01)

(52) U.S. Cl.

CPC ..... *B65H 45/142* (2013.01); *B65H 2801/27* (2013.01); *G03G 2215/00877* (2013.01); *G03G 15/6582* (2013.01); *G03G 15/6573* (2013.01); *B65H 29/60* (2013.01); *G03G 2215/00818* (2013.01); *B65H 2513/42* (2013.01); *G03G 2215/00426* (2013.01); *B65H 2301/164* (2013.01); *B65H 2511/414* (2013.01)

USPC ..... 399/407; 399/410; 399/408

(58) Field of Classification Search

CPC ..... G03G 2215/00286; G03G 15/6541
USPC ..... 399/407, 408, 410; 412/33
See application file for complete search history.

(56) References Cited

U.S. PATENT DOCUMENTS 5,032,876 A * 7/1991 Murakami ..... 399/410
5,778,300 A * 7/1998 Murakami et al. ..... 399/403
6,947,684 B2 * 9/2005 Fujii et al. ..... 399/90
7,373,095 B2 5/2008 Arai (Continued)

FOREIGN PATENT DOCUMENTS

JP 2004-284742 10/2004
JP 2005-156722 6/2005

(Continued)

OTHER PUBLICATIONS

Office Action issued May 15, 2012, in Japanese Patent Application No. 2007-298791.
Office Action issued Jan. 31, 2012, in Japanese Patent Application No. 2007-298791.

*Primary Examiner* — Matthew G Marini
(74) *Attorney, Agent, or Firm* — Oblon, Spivak, McClelland, Maier & Neustadt, L.L.P.

(57) ABSTRACT

A sheet processing apparatus includes a folding unit that folds a sheet, a sheet storing unit that stores the sheet folded by the folding unit, a post-processing unit that performs a non-fold process on the sheet transported from the folding unit, a path select unit that switches the sheet destination to the sheet storing unit or the post-processing unit, and a control unit that detects whether there is a fold process command and/or a non-fold process command, and controls the path select unit according to the detecting result. The control unit controls the path select unit to switch the sheet destination to the post-processing unit when there is a non-fold process command, regardless of a fold process command.

6 Claims, 5 Drawing Sheets

(56) References Cited

U.S. PATENT DOCUMENTS

| | | | | |
|---|---|---|---|---|
| 8,062,201 | B2 | 11/2011 | Mimura et al. | |
| 8,305,616 | B2 * | 11/2012 | Mori | 358/1.15 |
| 2003/0227652 | A1 * | 12/2003 | Masaki | 358/1.18 |
| 2004/0178554 | A1 * | 9/2004 | Ishida | 270/37 |
| 2007/0176357 | A1 | 8/2007 | Horio et al. | |

FOREIGN PATENT DOCUMENTS

| | | |
|---|---|---|
| JP | 2005-225675 | 8/2005 |
| JP | 2005-241929 | 9/2005 |
| JP | 2006-76776 | 3/2006 |
| JP | 2006-195414 | 7/2006 |

* cited by examiner

SHEET PROCESSING APPARATUS, AND IMAGE FORMING SYSTEM

CROSS-REFERENCE TO RELATED APPLICATIONS

This application is based upon and claims priority under 35 U.S.C. §119 to Japanese Patent Application No. 2007-298791, filed Nov. 19, 2007, the entire contents of which are hereby incorporated by reference.

BACKGROUND OF THE INVENTION

1. Field of the Invention

The present invention generally relates to a sheet post processing apparatus and a folding apparatus that folds sheets of an image forming system.

2. Description of the Background Art

As disclosed in Japanese Patent Application Laid-Open No 2004-284742, an image forming system having a sheet folding apparatus (also referred to as sheet processing apparatus) is generally arranged so that an image forming apparatus is at an upstream side of the sheet folding apparatus with respect to a sheet transport direction. Furthermore, a post-processing apparatus which performs non-folding process (e.g., punching, stapling, sorting, mixed loading) is arranged at a downstream side of the sheet folding apparatus with respect to the sheet transport direction.

In such an image forming system, the fold pattern of the sheet (folding mode) and the processing method of the sheet (processing mode) are able to be selected by a user with an operating device disposed in the image forming apparatus. However, the inventors have found that such a device may not have good user friendliness.

SUMMARY

Accordingly, it is an object of the present invention to at least partially solve the problems in the conventional technology.

A sheet processing apparatus according to one exemplary aspect of the present invention includes a folding unit, a sheet storing unit, a post-processing unit, a path select unit, and a control unit. The folding unit folds a sheet. The sheet storing unit stores the sheet folded by the folding unit. The post-processing unit performs a non-fold process against the sheet transported from the folding unit. The path select unit switches the sheet destination to the sheet storing unit or the post-processing unit. The control unit detects whether there is a fold process command and/or a non-fold process command, and controls the path select unit according to the detected result. The control unit controls the path select unit to switch the sheet destination to the post-processing unit when there is a non-fold process command regardless a fold process command.

In another exemplary aspect, a sheet processing apparatus includes a folding unit, a sheet storing unit, a post-processing unit, a path select unit, a control unit, an input unit. The folding unit folds a sheet. The sheet storing unit stores the sheet folded by the folding unit. The post-processing unit performs a non-fold process against the sheet transported from the folding unit. The path select unit switches the sheet destination to the sheet storing unit or the post-processing unit. The control unit controls the path select unit. The input unit is for inputting fold and non-fold commands. When the fold command is an impossible command that is not possible to perform non-fold process by the post-processing unit, the input unit transmits either the fold or non-fold commands to the control unit and discards the other command.

In another exemplary aspect, a sheet processing apparatus includes a folding, a sheet storing unit, a post-processing unit, a path select unit, a control unit, and an input unit. The folding unit folds a sheet. The sheet storing unit stores the sheet folded by the folding unit. The post-processing unit performs a non-fold process against the sheet transported from the folding unit. The path select unit switches the sheet destination to the sheet storing unit or the post-processing unit. The control unit controls the path select unit. The input unit is for inputting fold and non-fold commands. The input unit prohibits to input both of a fold command that is not possible to perform non-fold process by the post-processing unit and a non-fold command.

According to the above-described sheet processing apparatuses, it is possible to switch transport destination to the best destination corresponding to the folding command or post-processing command. This makes it possible to improve user-friendliness.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Preferred embodiments of the present invention are described hereinafter with reference to the accompanying drawings.

Figure 1:
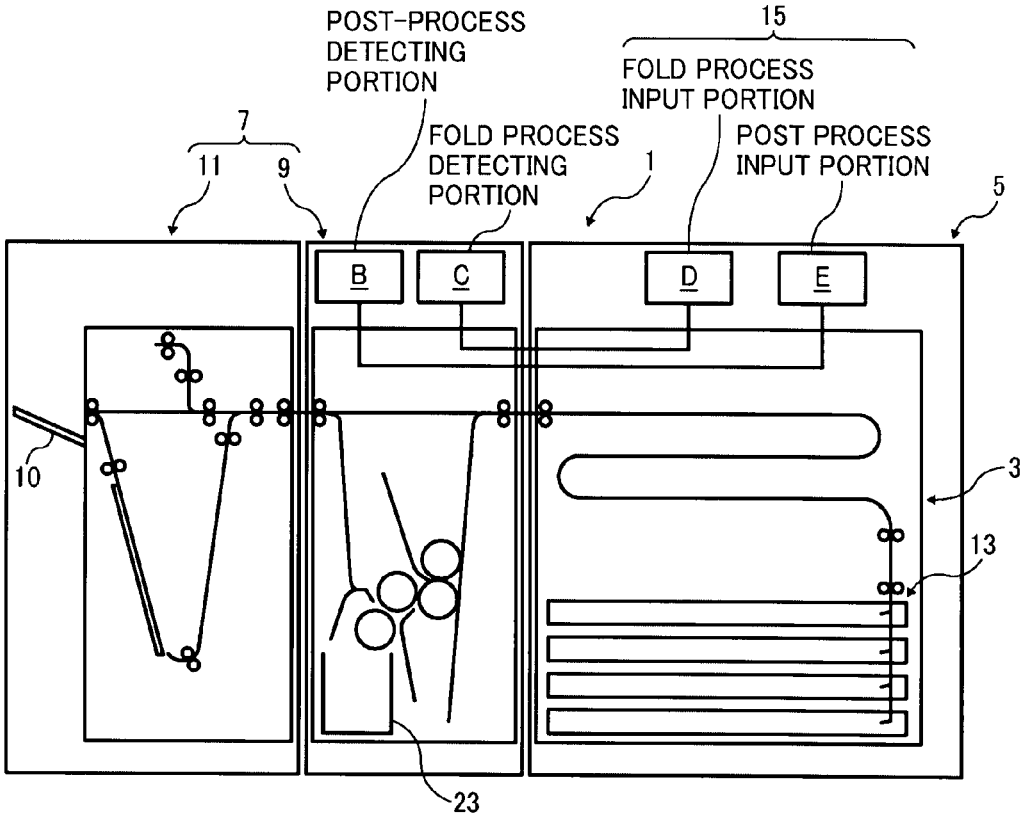
FIG. 1 schematically illustrates a configuration of the image forming system according to an embodiment of the present invention.
Figure 2:
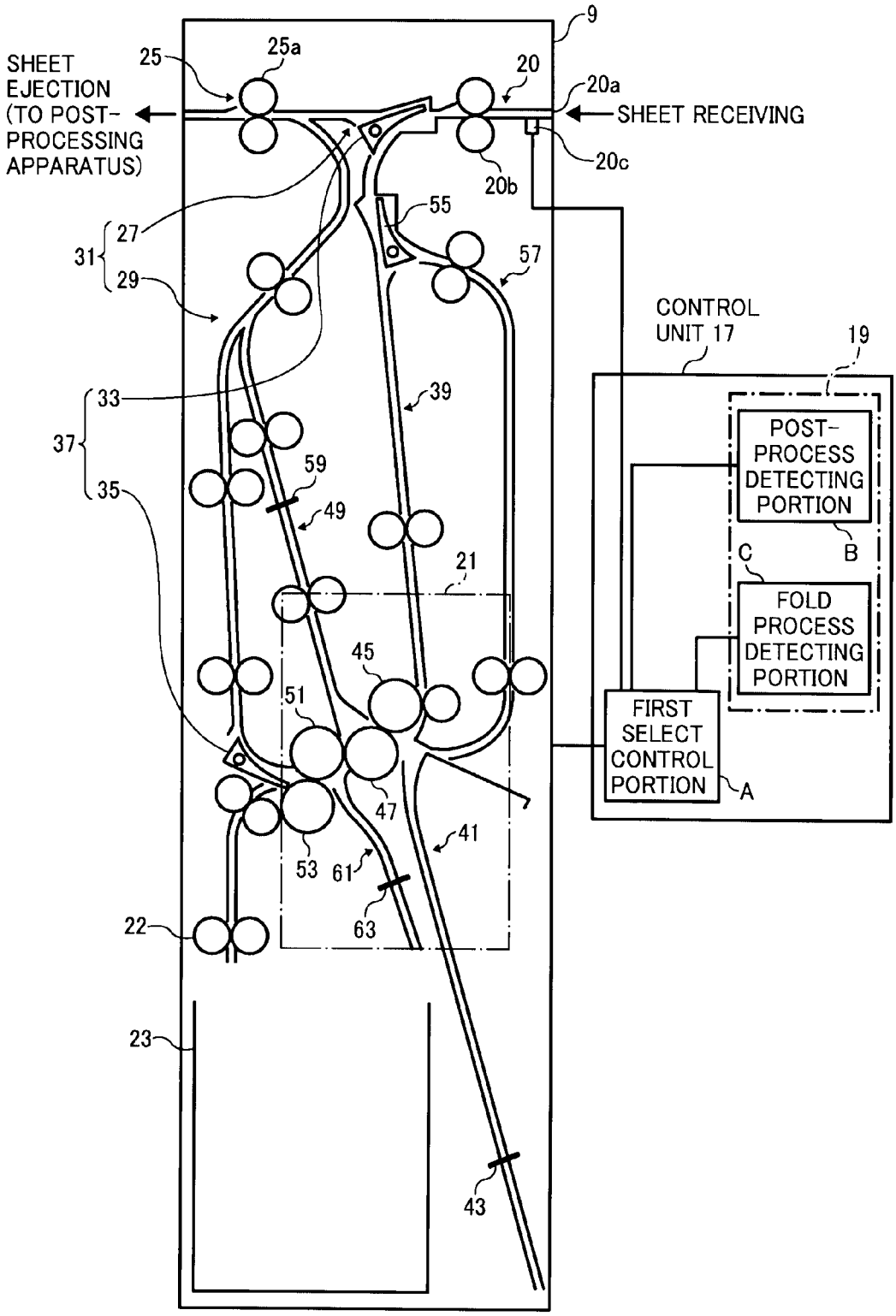
FIG. 2 schematically illustrates a sheet folding apparatus of FIG. 1.
Figure 3:
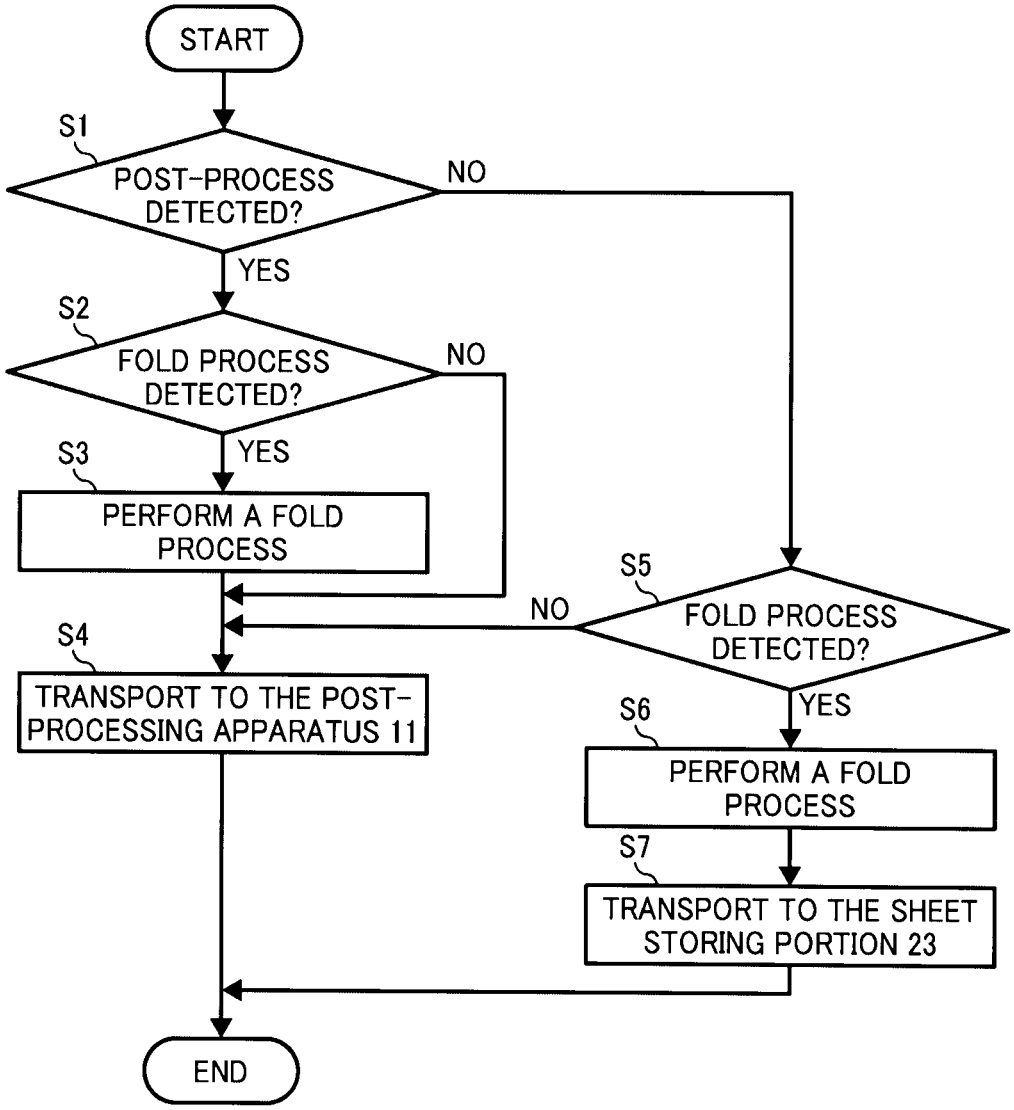
FIG. 3 is a flow diagram illustrating a control by a control unit of FIG. 1.

An image forming system of first embodiment of the present invention is described below with reference to FIGS. 1 through 3. FIG. 1 schematically illustrates a configuration of the image forming system. FIG. 2 schematically illustrates a sheet folding apparatus of FIG. 1. FIG. 3 is a flow diagram illustrating a control by a control unit of FIG. 1.

As shown in FIG. 1, an image forming system 1 includes an image forming apparatus 5 (e.g., copier, printer, facsimile, or a multifunction machine having one or more of those functions), which includes an image forming portion 3 to form an image on a sheet, and a sheet processing apparatus 7 which is connected to the image forming apparatus 5 and performs a predetermined process to the sheet ejected/transported from the image forming apparatus 5.

The sheet processing apparatus 7 includes a sheet folding apparatus 9, which folds the sheet transported from the image forming portion 3, and a post-processing apparatus 11 which performs a process which is in addition to the folding process to the sheet ejected/transported from the sheet folding apparatus 9 such as punching, stapling, sorting, mixed loading. The post-processing apparatus 11 includes a sheet stacking tray 10 which is a final destination of the sheet having the image formed thereon.

In other words, the image forming apparatus 5 is arranged at the upstream side of the sheet folding apparatus 9 with respect to the sheet transport direction, and the post-processing apparatus 11 is arranged at the downstream side of the sheet folding apparatus 9 with respect to the sheet transport direction.

The image forming apparatus 5 includes a sheet feeding cassette 13, which stores a sheet and feeds the sheet to the image forming portion 3, and an operating device 15 which is an input device to input various processing commands to the sheet processing apparatus 7 by users. The operating device 15 includes fold process input portion D to a input command of fold processing to the sheet folding apparatus 9 such as center fold command, Z fold command, outside three fold command, inside three fold command, four fold command, double parallel fold command and inside four fold command. The operating device 15 also includes post process input portion E to input commands of post-processing to the post-processing apparatus 11 such as punching command, stapling command, sorting command, mixed loading command. The operating device 15 including the fold process input portion D and/or the post process input portion E may be implemented using a touch screen user input panel and/or using dedicated hardware keys or buttons.

The image forming portion 3 includes a photoconductive drum, a charging unit, an image exposure unit, a developing unit, a transfer unit, and a fixing unit, for example. The photoconductive drum is an image carrier to hold an electrostatic latent image corresponding to an image scanned from a document by a scanner. The charging unit charges the surface of the photoconductive drum evenly. The image exposure unit forms the electrostatic latent image corresponding to the image scanned by the scanner on the photoconductive drum charged by the charging unit. The developing unit forms a toner image on the photoconductive drum by developing the electrostatic latent image with toner. The transfer unit transfers the toner image from the photoconductive drum to a sheet. The fixing unit fixes the toner image on the sheet.

The post-processing apparatus 11 includes a post processing device such as one or more of a punching unit that performs a punching process on the sheet, a stapling unit that includes a stapler so as to perform a stapling process, and so on.

The following describes an overview of the sheet folding apparatus 9 with reference to FIG. 2.

The sheet folding apparatus 9 includes a sheet receiving portion 20, a folding portion 21, a sheet storing portion 23, a sheet ejecting portion 25, a sheet transfer portion 31, and a path select portion 37. The sheet receiving portion 20 includes a sheet inlet 20*a* that receives the sheet transported from the image forming portion 3, sheet receiving rollers 20*b*, and a sheet detection sensor 20c that detects the received sheet. The folding portion 21 performs folding process against the sheet transported from the image forming portion 3. The sheet storing portion 23 stores the sheet folded by the folding portion 21 via sheet ejecting rollers 22. The sheet ejecting portion 25 includes ejection rollers 25*a* that transfers/ejects the sheet transported into the sheet folding apparatus 9 toward the post-processing apparatus 11. The sheet transfer portion 31 includes a first sheet path 27 that is formed between the downstream side of the sheet receiving portion 20 with respect to the sheet transport direction and the sheet ejecting portion 25, a second sheet path 29 that is formed between the downstream side of the folding portion 21 and the sheet ejection portion 25. The sheet transfer portion 31 transfers the sheet transported from the image forming portion 3 or the folding portion 21 toward the post-processing apparatus 11. The path select portion 37 includes a first path selector 33 that divides the sheet received by the sheet receiving portion 20 to the folding portion 21 and the first sheet path 27, and a second path selector 35 that divides the sheet folded by the folding portion 21 to the sheet storing portion 23 and the post-processing apparatus 11.

Furthermore, the sheet folding apparatus 9 also includes a control unit 17. The control unit 17 includes a first select control portion A, a post-process detecting portion B, a fold process detecting portion C, and a determining portion 19. The fold process detecting portion C is arranged to be able to communicate with a fold process input portion D and detects a fold process command by receiving various commands from the fold process input portion D. The post-process detecting portion B is arranged to be able to communicate with a post-process input portion E and detects a post-process command by receiving various commands from the post-process input portion E. The determining portion 19 determines whether there is a command for the post-process detecting portion B or the fold process detecting portion C. The first select control portion A controls the path select portion 37 based on the result determined by the determining portion 19. The control unit 17 is arranged to communicate with the sheet detection sensor 20*c* and detects a sheet which passes the sheet detection sensor 20*c*.

In this embodiment, the sheet folding apparatus 9 is able to perform center fold, Z fold, outside three fold, inside three fold, double parallel fold and inside four fold according with command. In the following sections, each folding process is described.

The following describes the center fold process. The sheet is guided to a third sheet path 39 by the first path selector 33. The leading edge of the sheet bumps into a first stopper 43 that is arranged in a fourth sheet path 41 and movable to a folding position, and a bend of the sheet is formed. Then a first fold of the sheet is performed by inserting the bend of the sheet into a nip of a first folding roller 45 and a second folding roller 47. After the first fold, the sheet is not transported into a fifth sheet path 49. The sheet passes through a nip of the second folding roller 47 and a third folding roller 51, and a nip of the third folding roller 51 and a fourth folding roller 53. This will complete the folding process.

The following describes Z fold process. The sheet is guided to a sixth sheet path 57 by the first path selector 33 and a fifth path selector 55. The sheet passes through a nip of the first folding roller 45 and the second folding roller 47 and bumps into a second stopper 59 that is arranged in the fifth sheet path 49 and movable to a folding position, and a bend of the sheet is formed. Then a first fold of the sheet is performed by inserting the bend of the sheet into the nip of the second folding roller 47 and the third folding roller 51. After the first fold, the sheet is transported to a seventh sheet path 61. Then the leading edge of the sheet bumps into a third stopper 63 that is arranged in a seventh sheet path 61 and movable to a folding position, and a second bend of the sheet is formed. Then a second fold of the sheet is performed by inserting the second bend of the sheet into the nip of the third folding roller 51 and the fourth folding roller 53. This will complete the folding process.

The following describes an outside three fold process, an inside three fold process, and a double parallel fold process.

The sheet is guided to a third sheet path 39 by the first path selector 33. The leading edge of the sheet bumps into the first stopper 43 that is arranged in a fourth sheet path 41 and movable to a folding position, and a bend of the sheet is formed. Then a first fold of the sheet is performed by inserting the bend of the sheet into the nip of a first folding roller 45 and a second folding roller 47. After the first fold, the sheet is transported into a fifth sheet path 49. The leading edge of the sheet bumps into a second stopper 59 that is arranged in the fifth sheet path 49 and movable to a folding position, and a second bend of the sheet is formed. Then a second fold of the sheet is performed by inserting the second bend of the sheet into the nip of the second folding roller 47 and the third folding roller 51. After the second fold, the sheet is not transported into a seventh sheet path 61. The sheet passes through the nip of the third folding roller 51 and a fourth folding roller 53. This completes the folding process.

The following describes an inside four fold process. The sheet is guided to a third sheet path 39 by the first path selector 33. The leading edge of the sheet bumps into the first stopper 43 that is arranged in a fourth sheet path 41 and movable to a folding position, and a bend of the sheet is formed. Then a first fold of the sheet is performed by inserting the bend of the sheet into the nip of a first folding roller 45 and a second folding roller 47. After the first fold, the sheet is transported into a fifth sheet path 49. The leading edge of the sheet bumps into a second stopper 59 that is arranged in the fifth sheet path 49 and movable to a folding position, and a second bend of the sheet is formed. Then a second fold of the sheet is performed by inserting the second bend of the sheet into the nip of the second folding roller 47 and the third folding roller 51. After the second fold, the sheet is transported into a seventh sheet path 61. Then the leading edge of the sheet bumps into the third stopper 63 that is arranged in the seventh sheet path 61 and movable to a folding position, and a third bend of the sheet is formed. A third fold of the sheet is performed by inserting the third bend of the sheet into the nip of the third folding roller 51 and the fourth folding roller 53. This will complete the folding process.

The following describes a control of the sheet folding apparatus 9 by the control unit 17 in the constitution described above with reference to FIG. 3.

First, the sheet detection sensor 20*c* detects that the sheet inlet 20*a* of sheet receiving portion 20 receives a sheet. Then, the determining portion 19 determines whether there is any command. When the post-process detecting portion B detects any post-process command and the fold process detecting portion C detects any fold process command (when S1 is "yes" and S2 is "yes" in FIG. 3), the folding portion 21 performs the folding process detected by the fold process detecting portion C against the sheet (S3). After that, the sheet is ejected toward the post-processing apparatus 11 via the sheet ejecting portion 25 by switching the second path selector 35 of the path select portion 37 so that the sheet destination becomes the second sheet path 29 of the sheet transfer portion 31 by the first select control portion A (S4).

Meanwhile, when the post-process detecting portion B detects any post-process command and the fold process detecting portion C does not detect any fold process command (when S1 is "yes" and S2 is "no" in FIG. 3), the process proceeds to S4. In other words, the sheet received from the sheet receiving portion 20 is ejected toward the post-processing apparatus 11 via the ejection rollers 25*a* of the sheet ejecting portion 25 by switching the first path selector 33 of the path select portion 37 so that the sheet destination becomes the first sheet path 27 of the sheet transfer portion 31 by the first select control portion A.

As described above, when the determining portion 19 detects any post-process command, the sheet destination is changed to the sheet transfer portion 31 by the path select portion 37 regardless of the existence of fold process command. This makes it possible to perform post-process automatically such as punching, stapling, sorting, mixed loading against the sheet even if the sheet is folded or not folded.

When the post-process detecting portion B does not detect any post-process command and the fold process detecting portion C also does not detect any fold process command (when S1 is "no" and S5 is "no" in FIG. 3), the sheet received from the sheet receiving portion 20 is ejected toward the post-processing apparatus 11 via the ejection rollers 25*a* of the sheet ejecting portion 25 by switching the first path selector 33 of the path select portion 37 so that the sheet destination becomes the first sheet path 27 of the sheet transfer portion 31 by the first select control portion A (S4).

Meanwhile, when the post-process detecting portion B does not detect any post-process command and the fold process detecting portion C detects any fold process command (when S1 is "no" and S5 is "yes" in FIG. 3), the folding portion 21 performs the folding process detected by the fold process detecting portion C against the sheet (S6). After that, the sheet is ejected toward the sheet storing portion 23 via the sheet ejecting rollers 22 by switching the second path selector 35 of the path select portion 37 so that the sheet destination becomes the sheet storing portion 23 by the first select control portion A (S7).

As described above, in case of that the determining portion 19 does not detect any post-process command and any fold process command, the sheet destination is changed to the sheet transfer portion 31 by the path select portion 37. And in case of that the determining portion 19 does not detect any post-process command and detects any fold process command, the sheet destination is changed to the sheet storing portion 23 by the path select portion 37. In other words, the sheet that is not subjected to the fold process is ejected to the post-processing apparatus 11, and the sheet that is only subjected to the fold process is ejected to the sheet storing portion 23. Therefore, the sheet storing portion 23 stores only folded sheets. This makes it possible to reduce the space of the sheet storing portion 23. In addition, because there is the sheet storing portion 23, it prevents the sheet stacking tray 10 from wasting storing space.

As described above, according to the first embodiment, the sheet destination is switched to the appropriate destination corresponding to the fold process and the post-process automatically by the control unit 17. This makes it possible to improve the user-friendliness.

Further embodiments of the present invention are described below. In the following discussion, descriptions of the same parts as in the first embodiment may be omitted by using the same reference symbols as in the first embodiment for the same parts.

Figure 4:
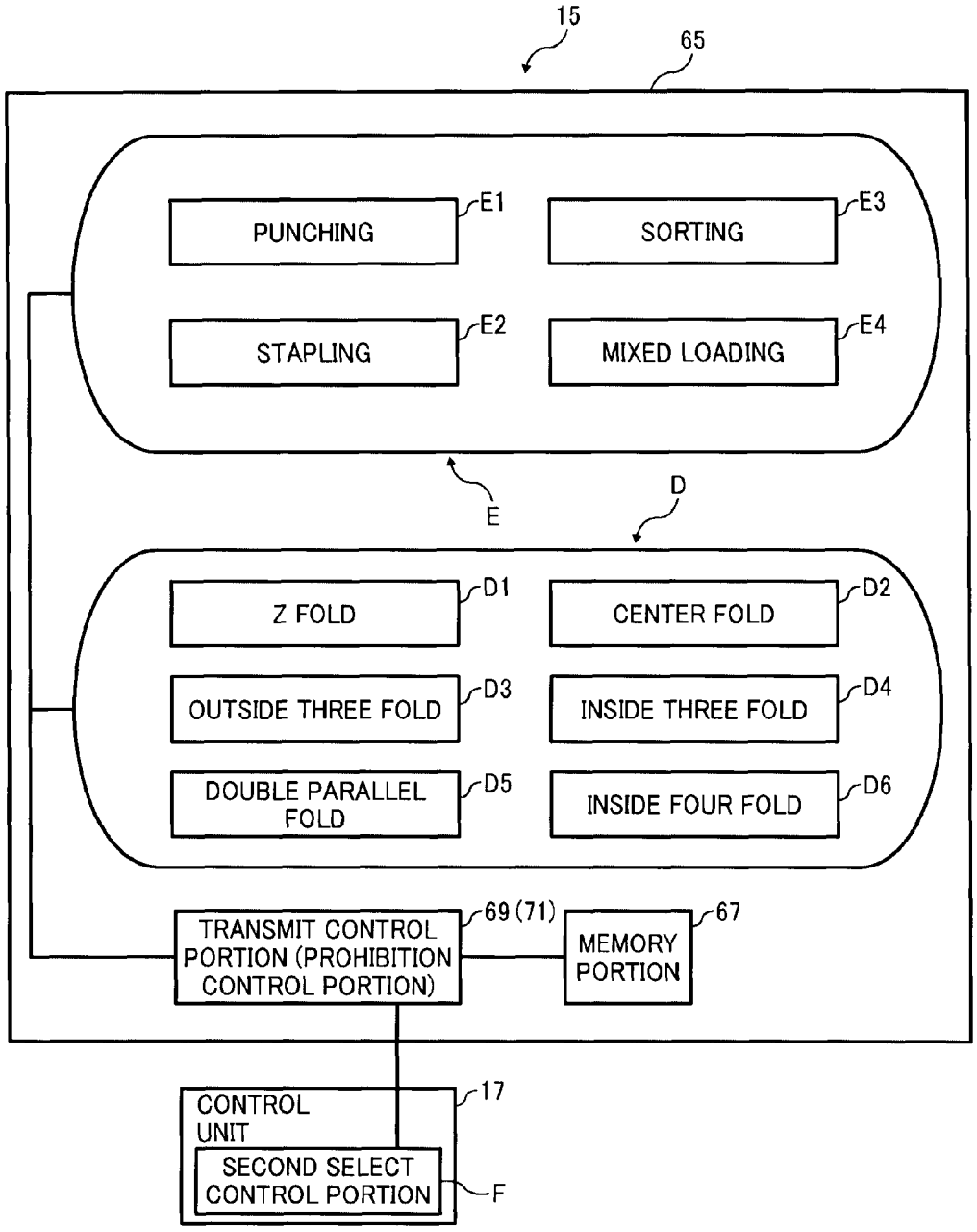
FIG. 4 is a block diagram of illustrating an operating unit according to the second embodiment of the present invention.
Figure 5:
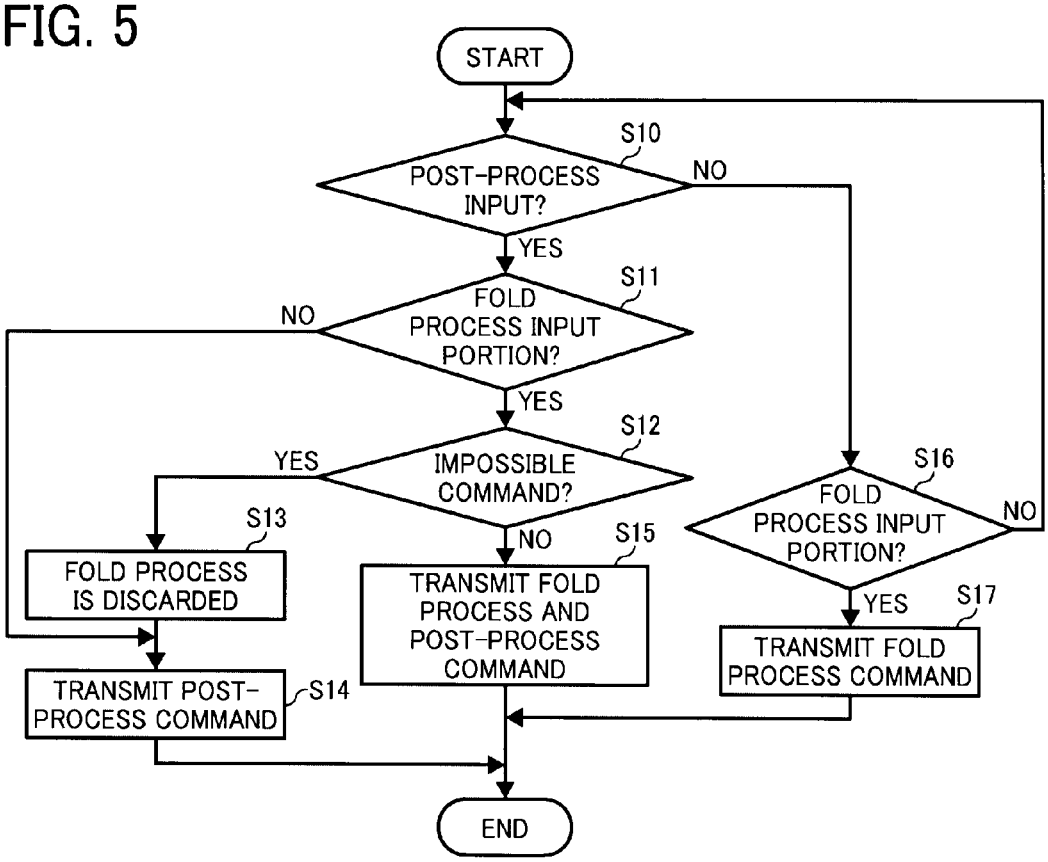
FIG. 5 is a flow diagram of illustrating a transmitting control by a transmit control portion according to the second embodiment of the present invention.

A second embodiment is described below with reference to FIG. 4 and FIG. 5. FIG. 4 is a block diagram illustrating an operating unit according to the second embodiment of the present invention. FIG. 5 is a flow diagram illustrating a transmitting control by a transmit control portion according to the second embodiment of the present invention.

As shown in FIG. 4, the second embodiment of the present invention is different from the first embodiment in that the control unit 17 of the sheet folding apparatus 9 does not includes the determining portion 19 and includes a second select control portion F instead of the first select control portion A. The second select control portion F switches the sheet destination to the sheet transfer portion 31 when receiving a post-process command for the post-processing apparatus 11, and to the sheet storing portion 23 when receiving a fold process command for the folding portion 21.

The operating device 15 mounted on the image forming apparatus 5 includes an input portion 65 so as to input each kind of command. The input portion 65 includes a fold process input portion D, a post-process input portion E, a memory portion 67 which may be implemented using any desired memory, and a transmit control portion 69. The fold process input portion D includes fold process input buttons D1, D2, D3, D4, D5, D6 so as to input each fold command such as a Z fold command, a center fold command, an outside three fold command, an inside three fold command, a double parallel fold command, or an inside four fold command. The post-process input portion E includes post-process input buttons E1, E2, E3, E4 so as to input post-process command such as a punching command, a stapling command, a sorting command, and a mixed loading command. The memory portion 67 stores commands that are not performed (e.g., impossible commands) by the post-processing apparatus 11, but include the fold process commands. The transmit control portion 69 controls by transmitting an appropriate command among the fold process commands, the post-process commands, and the impossible commands to the second select control portion F. An impossible command is a command which cannot be executed because it would create a situation which physically cannot occur or cannot occur properly. For example, after a sheet of paper has been folded in a certain manner, it cannot be properly stapled by the post-processing apparatus.

Regarding the fold process input buttons D1, D2, D3, D4, D5, D6 and the post-process input buttons E1, E2, E3, E4, it is possible to apply a physical push button or a touch-panel button or any other type of input device, as long as user can input a command.

In this embodiment, the outside three fold command, the inside three fold command, the double parallel fold command, and the inside four fold command are set as the impossible commands. The folded sheet is shorter with respect to the sheet transport direction and thicker than a non-fold sheet. Therefore, it is not possible to transport in the post-processing apparatus 11 or/and to perform a punching or stapling depending on the fold process (e.g., punching/stapling is impossible in third fold). For such fold commands, they are set as or considered to be impossible commands that are not possible to perform post-process by the post-processing apparatus 11. Of course it is possible to change the impossible commands, as desired.

The following describes a transmit control of commands by the transmit control portion 69 with reference to FIG. 5.

When a post-process command is selected with the post-process input portion E (e.g., punching process) and a fold process command is input with the fold process input portion D (when S10 is "yes" and S11 is "yes" in FIG. 5), the fold command is analyzed to determine whether it is an impossible command (S12).

In case of that the fold command is determined to be an impossible command in S12 (when S12 is "yes"), the fold command is discarded or ignored (S13) and only the post-process command is transmitted to the second select control portion F of the control unit 17 or executed (S14).

Meanwhile, when only a post-process command is selected with the post-process input portion E (when S10 is "yes" and S11 is "no" in FIG. 5), the post-process command is transmitted to the second select control portion F of the control unit 17 (S14).

The second select control portion F receives the command of step S14 and switches the first path selector 33 of the first path select portion 37 so that the destination of a sheet received from the receiving portion 20 becomes the first sheet path 27. Because of this, the sheet is ejected toward the post-processing apparatus 11 via the first sheet path 27 and the ejection rollers 25*a* of the sheet ejecting portion 25.

When the fold command is determined not to be an impossible command in S12 (when S12 is "no"), the fold command and the post-process command are transmitted to the second select control portion F of the control unit 17 (S15).

The second select control portion F receives the fold and post process commands of step S15, switches the first path selector 33 of the first path select portion 37 so that the destination of the sheet received from the receiving portion 20 becomes the folding portion 21, and switches the second path selector 35 of the first path select portion 37 so that the sheet destination after the folding portion 21 becomes the second sheet path 29. Because of this, the sheet is transported to the post-processing apparatus 11 after the folding portion 21 and performs the post-process corresponding to the post-process command.

Meanwhile, when only a fold process command is selected with the fold process input portion D (when S10 is "no" and S16 is "yes" in FIG. 5), the fold process command is transmitted to the second select control portion F of the control unit 17 (S17).

The second select control portion F receives the command of S17, and switches the second path selector 35 of the first path select portion 37 so that the sheet destination after the folding portion 21 becomes the sheet storing portion 23. Because of this, the sheet is ejected toward the sheet storing portion 23.

As described above, according to the second embodiment, it is possible to obtain the same effects as the first embodiment, and to improve the user-friendliness by switching the sheet destination to an appropriate destination corresponding to the fold process command and the post-process command automatically by the transmit control portion 69.

In this embodiment, the fold command is discarded when the fold command is determined to be an impossible command (when S10 is "yes", S11 is "yes", and S12 is "yes" in FIG. 5). However, it is also possible to discard the post-process command instead of the fold command and transmit the fold command to the second select control portion F.

Figure 6:
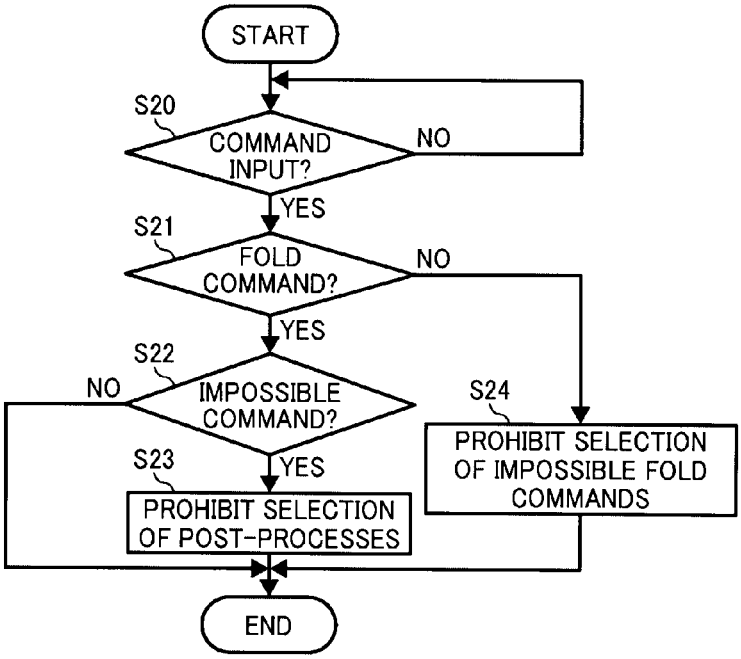
FIG. 6 is a flow diagram of illustrating a prohibition control by a prohibition control portion according to the third embodiment of the present invention.

A third embodiment is described below with reference to FIG. 4 and FIG. 6. The third embodiment of the present invention is different from the second embodiment in that a prohibition control portion 71, which prohibits both a post-process command and an impossible command stored in the memory portion 67 are input, is arranged instead of the transmit control portion 69. FIG. 6 is a flow diagram of illustrating a prohibition control by the prohibition control portion 71.

The prohibition control portion 71 controls the fold process input buttons D3, D4, and the post-process input buttons E1, E2, E3, E4 (or alternatively the control device which processes inputs from the buttons) so that the operation becomes impossible according to the input situation for the fold process input portion D and the post-process input portion E.

As shown in FIG. 6, when an input command is a fold command for the fold process input portion D (when S20 is "yes" and S21 is "yes" in FIG. 6), it is determined whether the command is an impossible command. When the fold command is determined to be an impossible command (when S22 is "yes"), all post-process input buttons E1, E2, E3, E4 of the post-process input portion E are controlled to become non-enterable so as to prohibit the selection of post-process commands for the post-processing apparatus 11.

When the fold command is distinguished as a non-impossible command (when S22 is "no"), all input buttons E1, E2, E3, E4 of the post-process input portion E are maintained in the enterable state. Users can select a post-process command for the post processing apparatus 11 arbitrarily. The second select control portion F performs similar control as the second embodiment.

When the fold command is determined to be an impossible command in step S22, flow proceeds to step S23 which prohibits the selection of the post-processing. For example, if the user selects a stapling command as the post-process command, step S24 will prohibit certain types of folding from being performed such as the outside three fold, the inside three fold, the double parallel fold, and the inside four fold as it is impossible to properly staple paper which has been folded in this manner.

When the input command is a post-process command for the post-process input portion E (when S20 is "yes" and S21 is "no" in FIG. 6), flow proceeds to S24 and the fold process input buttons D3, D4, D5, D6 corresponding to the impossible commands among the all buttons of the fold process input portion D are controlled to become non-enterable so as to prohibit their selection. In other words, the Z fold command and the center fold command, for example, are only possible to be selected for the sheet folding apparatus 9.

As described above, according to the third embodiment, it is possible to obtain the same effects as the second embodiment, and to prevent a user's confusion of the sheet destination by showing the sheet destination definitely. This makes it possible to improve the user-friendliness.

The various control structures, control units, detecting portions and input portions may be implemented using general purpose processors programmed according to the teachings of this invention. Alternatively, these elements may be implemented using hardware including special purposes processors, application specific integrated circuits, discrete components, or any combination of these elements including a general purpose processor.

Numerous additional modifications and variations are possible in light of the above teachings. It is therefore to be understood that within the scope of the appended claims, the disclosure of the present invention may be practiced otherwise than as specifically described herein.

In the above mentioned example, the operating device 15 and the control unit 17 are arranged in the sheet folding apparatus 9. However, it is possible to arrange at least one of the operating device 15 and the control unit 17 in the image forming apparatus 5 or the post-processing apparatus 11.

Furthermore, in the above mentioned example, the sheet folding apparatus 9 and the post-processing apparatus 11 are arranged separately. However, it is possible to arrange the sheet folding apparatus 9 and the post-processing apparatus 11 in one.

What is claimed is:

1. A sheet processing apparatus comprising:

a folding unit including a folding portion that folds a sheet, the folding unit to perform one of multiple types of folds, in accordance with a fold process command;

a sheet storing unit that stores the sheet folded by the folding unit;

a post-processing unit that performs a non-fold process on the sheet transported from the folding unit in accordance with a non-fold process command;

a path select unit that can route the sheet to the folding portion, and can alternatively route the sheet to the post-processing unit; and a control unit that detects a fold process command and a non-fold process command, and controls the path select unit according to the detecting result, wherein:

the control unit controls the path select unit to route the sheet to the post-processing unit and not to the folding portion so that folding is not performed, when there is both a first type of fold process command and a non-fold process command for the sheet, the first type of fold process command and the non-fold process command being impossible to perform on a same sheet by the sheet processing apparatus, and the control unit controls the path select unit to route the sheet to the folding portion so that folding is performed, when there is both a second type of fold process command and a non-fold process command for the sheet, the second type of fold process command and the non-fold process command being possible to perform on the same sheet by the sheet processing apparatus.

2. An image forming system comprising the sheet processing apparatus according to claim 1.

3. The sheet processing apparatus according to claim 1, wherein:

the folding unit includes the sheet storing unit.

4. The sheet processing apparatus according to claim 1, wherein:

the folding unit includes the path select unit.

5. The sheet processing apparatus according to claim 1, wherein:

the sheet storing unit is an end of a transport route and sheets are removed from the sheet storing unit manually.

6. The sheet processing apparatus according to claim 1, wherein:

the control unit further controls the post-processing unit to perform the non-fold process on the sheet, after the folding is performed, when there is both the second type of fold process command and the non-fold process command for the sheet.

* * * * *